US006745688B1

(12) United States Patent
Lemelin et al.

(10) Patent No.: US 6,745,688 B1
(45) **Date of Patent: *Jun. 8, 2004**

(54) LITHOGRAPHIC WEB-FED ROTARY PRINTING PRESS

(75) Inventors: Michael Robert Lemelin, Dover, NH (US); Dale Hiett Jackson, Newmarket, NH (US); Mark Bernard Dumais, Kennebunk, ME (US); John Sheridan Richards, Barrington, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 991 days.

(21) Appl. No.: 09/052,472

(22) Filed: Mar. 31, 1998

(51) Int. Cl.[7] ..... B41F 7/10; B41C 1/00

(52) U.S. Cl. ..... 101/138; 101/176; 101/180; 101/221

(58) Field of Search ..... 101/136, 137, 101/138, 142, 143, 175, 176, 177, 179, 180, 181, 220, 221, 222, 223

(56) References Cited

U.S. PATENT DOCUMENTS

| | | | | |
|---|---|---|---|---|
| 4,240,346 A | * | 12/1980 | Landis et al. | 101/180 |
| 4,281,595 A | * | 8/1981 | Fujishiro | 101/177 |
| 4,488,483 A | * | 12/1984 | Kohara | 101/178 |
| 4,774,883 A | * | 10/1988 | Mailander | 101/137 |
| 4,788,912 A | * | 12/1988 | Fischer | 101/177 |
| 5,134,934 A | * | 8/1992 | Knauer et al. | 101/218 |
| 5,136,942 A | | 8/1992 | Germann | 101/177 |
| 5,467,710 A | * | 11/1995 | Wirz | 101/230 |
| 5,479,856 A | * | 1/1996 | Wirz | 101/183 |
| 5,660,108 A | * | 8/1997 | Pensavecchia | 101/177 |

FOREIGN PATENT DOCUMENTS

| | | |
|---|---|---|
| DE | 407 369 | 12/1924 |
| DE | 41 13 12 | 3/1925 |
| DE | 32 20 542 | 12/1983 |
| DE | 196 12 927 | 11/1996 |
| EP | 0 132 858 | 2/1985 |
| GB | 2 275 019 | 8/1994 |

* cited by examiner

*Primary Examiner*—Stephen R. Funk
(74) *Attorney, Agent, or Firm*—Kenyon & Kenyon

(57) ABSTRACT

A web-fed rotary printing press (1) for alternatively printing, in a perfecting mode, a single web (10) or, in a non-perfecting mode, first and second webs (6, 8), comprises a first impression cylinder (16) having a plurality of first blanket cylinders (22*a*, 22*b*, 22*c*, 22*d*) and a corresponding plurality of second plate cylinders (24*a*, 24*b*, 24*c*, 24*d*) arranged along a periphery of the first impression cylinder (16). A second impression cylinder (18) located adjacent to the first impression cylinder (16) has a plurality of second blanket cylinders (28*a*, 28*b*, 28*c*, 28*d*) and a corresponding plurality of second plate cylinders (30*a*, 30*b*, 30*c*, 30*d*) arranged along a periphery thereof. In the perfecting mode, the single web (10) is passed over first impression cylinder (16) to be printed on a first side (10*a*) thereof and is afterwards passed through a gap (20) between the first and second impression cylinders (16, 18) to the second impression cylinder (18) to be printed on a second side (10*b*) thereof. In the non-perfecting mode, the first web (6) is passed over the first impression cylinder (16) and the second web (8) is passed over the second impression cylinder (18).

14 Claims, 4 Drawing Sheets

LITHOGRAPHIC WEB-FED ROTARY PRINTING PRESS

BACKGROUND OF THE INVENTION

The present invention relates to a lithographic web-fed rotary printing press for printing high quality images on a running paper web. In particular, the present invention relates to a web-fed rotary printing press which can be operated in a perfecting mode for printing multi-color images on both sides of a single web or which can alternatively be run in a non-perfecting mode for printing a multi-color image on a first web and if desired a second multi-color image on a second side of a second web.

Printers of high quality images, e.g. magazines, brochures and advertisements, etc., tend to employ more and more compact printing presses, while at the same time it is desired to further increase the productivity or speed of the presses and the quality of the printed products. Moreover, there is the further desire to achieve a more flexible press design which, particularly in the market of short run color printing (SRCP), allows for a larger number of different kinds of print jobs to be run on the same printing press, accommodating the growing variety of printed products and the reduction of the average number of products printed in each print job.

In practice, however, it is often required to run a first print job in a perfecting mode, in which both sides of a running paper web are printed with different multi-color images at the same time, and afterwards run a high speed print job in a non-perfecting mode, in which only one side of a paper web is printed with a multi-color image.

U.S. Pat. No. 5,136,942 purports to disclose a printing press for printing banknotes, in which a web is passed around a first impression cylinder to be printed on a first side with a first multi-color image and is afterwards passed around a second impression cylinder adjacent to the first impression cylinder, to be printed with a second multi-color image on the second side. The described banknote press does not permit the printing of two multi-color images on two different webs running through the printing press at the same time.

European Patent Publication No. 0 132 858 describes a printing press with a blanket to blanket printing unit for printing banknotes. The printing unit has first and second separable blanket cylinders, each of which is in contact with four plate cylinders for consecutively applying four images of different colors directly onto each blanket cylinder, thereby providing complete first and second multi-color images on each blanket cylinder. Afterward, when the cylinders are brought into contact with each other, the multi-color images provided on the first and second blanket cylinders are transferred to the web running between the blanket cylinders. In order to provide for a free passage of the web, e.g. when the printing unit is not in operation and no transfer of images to the web is desired, the first and second blanket cylinders are separated from each other. This printing press does not permit simultaneous processing of two webs in a non-perfecting mode.

SUMMARY OF THE INVENTION

It is an object of the present invention to provide a high speed web-fed rotary printing press which can be operated in either a perfecting mode or a non-perfecting mode, to print either high quality images on both sides of a single web or single images on a first side of a first web and, if desired, on a second side of a second web.

It is a further object of the present invention to provide a highly flexible printing press which may be adapted to different print jobs which are consecutively run on the printing press.

The present invention is directed to a printing unit for a web-fed rotary printing press for alternatively printing only a first web in a perfecting mode and for printing the first web and a second web in a non-perfecting mode, wherein the first and second webs travel through the printing unit from an upstream end to a downstream end thereof. The printing unit comprises a first impression cylinder having a plurality of first blanket cylinders and a corresponding plurality of first plate cylinders arranged around at least a portion of a periphery thereof and a second impression cylinder located adjacent to the first impression cylinder and having a plurality of second blanket cylinders and a corresponding plurality of second plate cylinders arranged around at least a portion of a periphery thereof. In the perfecting mode, the first web is passed over the first impression cylinder to be printed on a first side thereof and is then passed through a gap between the first and second impression cylinders to the second impression cylinder to be printed on a second side thereof, and, in the non-perfecting mode, the first web is passed over the first impression cylinder and the second web is passed over the second impression cylinder.

According to a further embodiment of the invention, any of the first and/or second plate cylinders and its respective first and/or second blanket cylinder may comprise a direct imaging unit while the remaining plate cylinder/blanket cylinder units may comprise offset printing units.

According to a further object of the present invention, first and second infeed rollers are arranged upstream of the first and second impression cylinders, in order to feed the incoming first and second webs substantially tangentially to the first and second impression cylinders, respectively, and to the corresponding one of the first and second blanket cylinders.

According to a further exemplary embodiment of the present invention, first and second exit rollers are provided downstream of the first and second impression cylinders, in order to pass the respective webs substantially tangentially away from the respective one of the first and second impression cylinders and the respective one of the first and second blanket cylinders.

According to a further exemplary embodiment of the invention, dryers are provided for drying, in the perfecting mode, the first and/or second sides of the single web and, in the non-perfecting mode, for drying the first and second webs.

The present invention eliminates elongation or fan out of the web which is usually caused by dampening liquids in prior art printing presses having printing units for applying different colors separated from each other. Therefore, printing quality is improved.

The present invention also allows a make-ready operation to be performed on the blanket and/or plate cylinders associated with one of the first and second impression cylinders, while, at the same time, the other one of the first and second impression cylinders can be used for printing the web in a non-perfecting mode.

Moreover, the time required for make-ready operations can be further reduced if the printing press is equipped with inking units for applying known single fluid inks to the printing plates of the respective plate cylinders associated with each impression cylinder.

DETAILED DESCRIPTION

Figure 1:
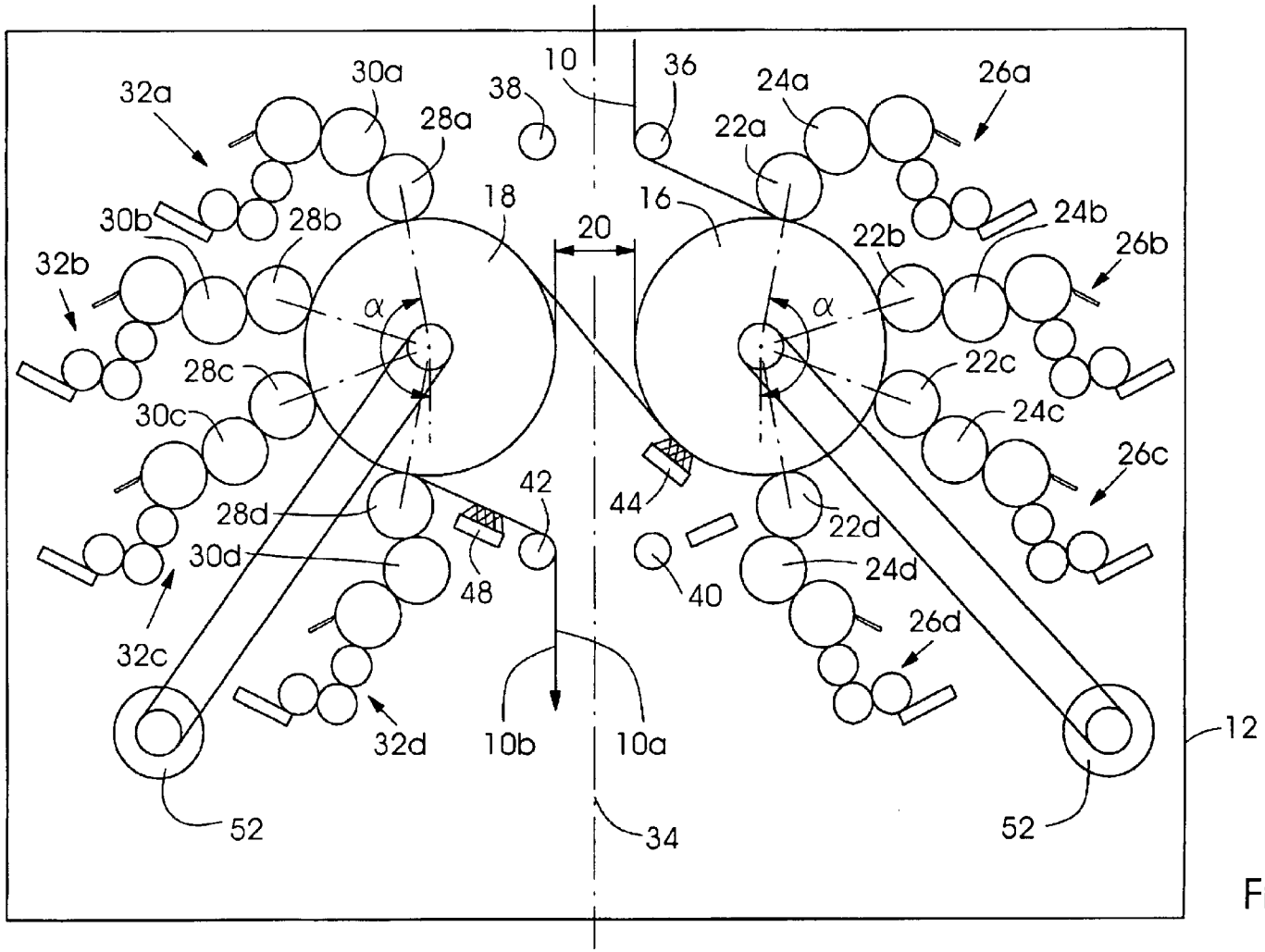
FIG. 1 shows an exemplary printing unit of a web-fed rotary printing press according to the present invention operated in the perfecting mode.

The present invention may be further understood with reference to the following description and the appended drawings, wherein like elements are provided with the same reference numerals.

Figure 3:
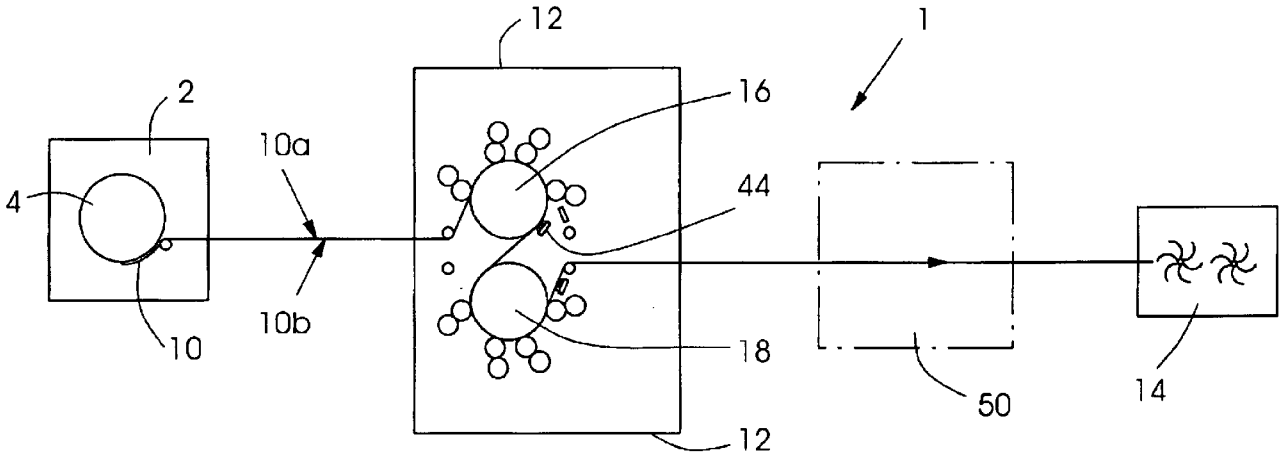
FIG. 3 is a schematic overview of a printing press with a printing unit according to the present invention wherein the web is traveling substantially vertically through the printing unit, and the printing unit is operated in a perfecting mode.
Figure 4:
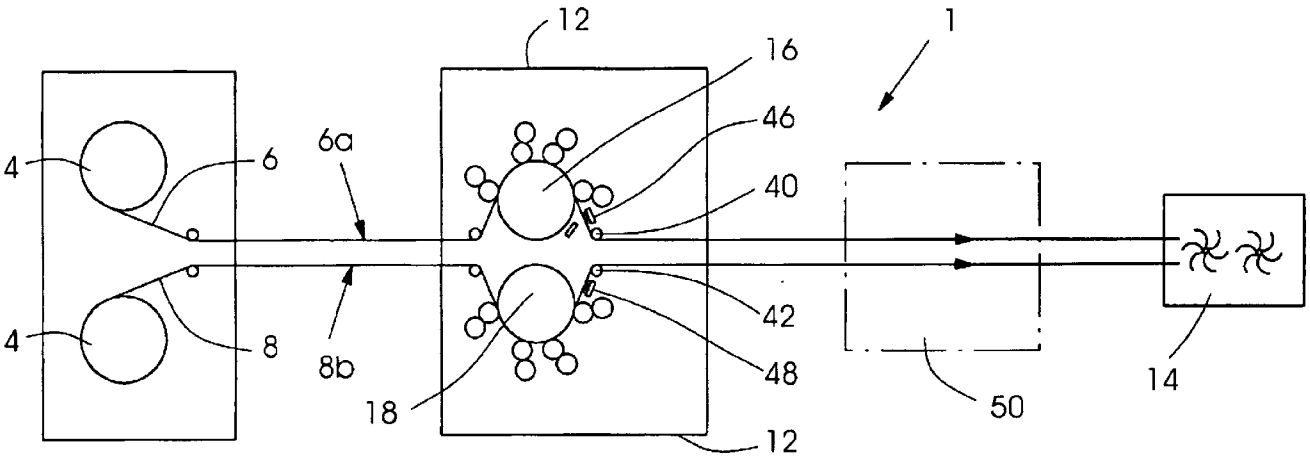
FIG. 4 shows the printing press of FIG. 3 when printing two webs in a non-perfecting mode.

As shown in FIGS. 3 and 4, a printing press 1 comprises a reel stand 2 with one or two paper reels 4 for feeding to a printing unit 12, in a non-perfecting mode, first and second webs 6, 8, to print only on outer facing side 6*a* of the first web 6 and outer facing side, 8*b* of the second web 8. In a perfecting mode, a single web 10 is fed to the printing unit 12 to be printed on both sides 10*a*, 10*b* thereof. Afterwards, the printed webs 6, 8, 10 are fed for further processing from the printing unit 12 to a known folding apparatus 14 schematically indicated in FIGS. 3 and 4 by two fan blade arrangements.

Figure 2:
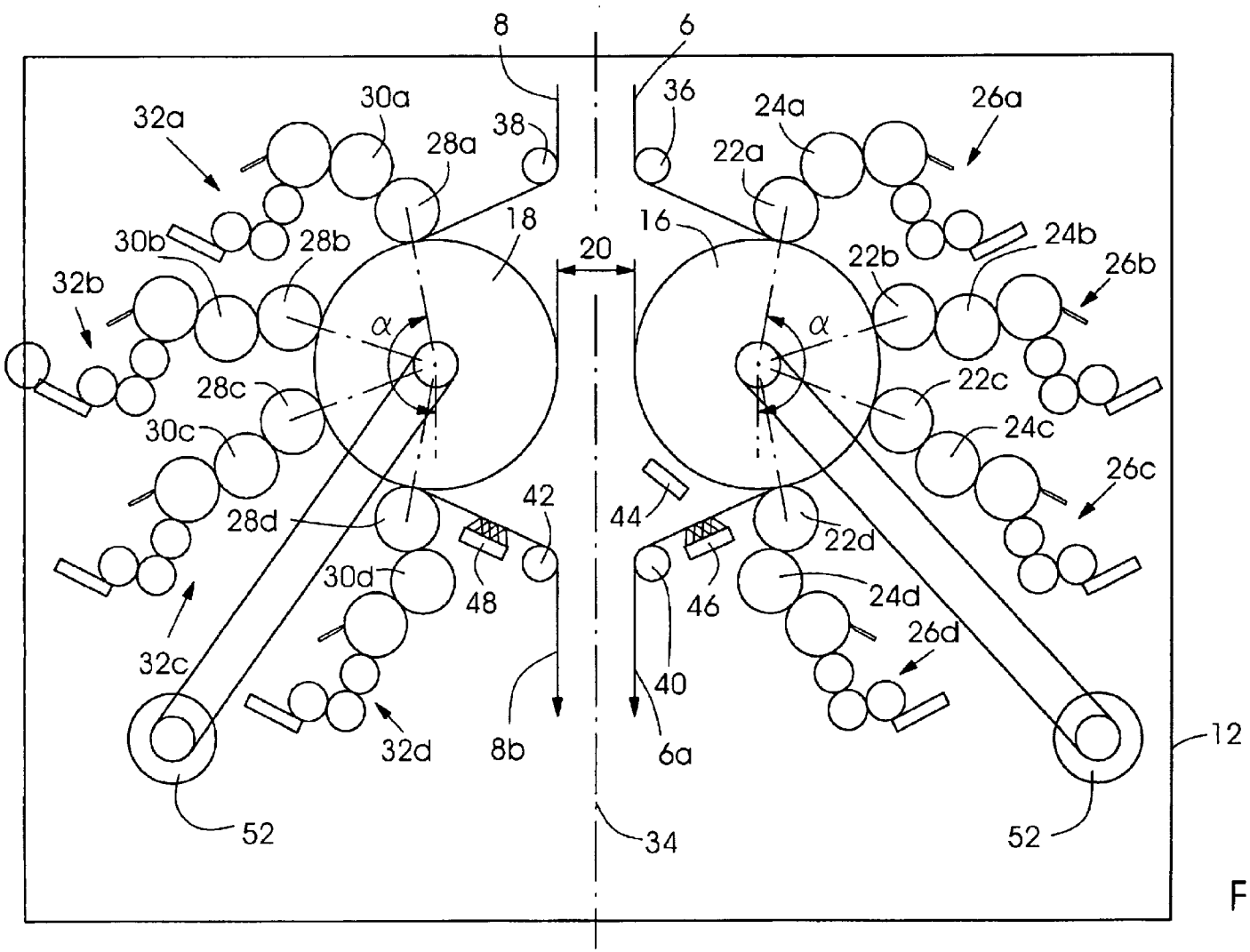
FIG. 2 shows the printing unit of FIG. 1 operated in the non-perfecting mode, in which two different webs are either printed on one side or in which a first web is printed on one side, while a second web is stopped for a make ready operation.

FIGS. 1 and 2 show in detail an exemplary embodiment of a printing unit 12 according to the present invention in which, in contrast to the embodiment shown in FIGS. 3 and 4, the web is traveling through the printing unit 12 in a substantially vertical direction. The printing unit 12 according to this embodiment of the present invention comprises a first impression cylinder 16 and a second impression cylinder 18 arranged adjacent to each other such that a gap 20 is provided between the two impression cylinders 16, 18. The gap 20 may preferably have a width of approximately 10 to 20 mm, although the width may be larger or smaller. In fact, the width of the gap 20 may even be reduced to zero so that the first and second impression cylinders 16, 18 are directly in contact with each other.

As shown in detail in FIGS. 1 and 2, arranged along a first periphery of the first impression cylinder 16 is a plurality of first blanket cylinders 22*a*, 22*b*, 22*c*, 22*d* and corresponding pluralities of first plate cylinders 24*a*, 24*b*, 24*c*, 24*d* and first inking units 26*a*, 26*b*, 26*c*, 26*d* for printing four images of a different color, e.g. cyan, magenta, yellow and black, on a first side 6*a*, 10*a* of either the first web 6 or the single web 10. The arrangement of the first blanket cylinders 22*a*, 22*b*, 22*c*, 22*d* and corresponding first plate cylinders 24*a*, 24*b*, 24*c*, 24*d* may preferably be of the known satellite-type, whereby an angle a over which the first blanket and plate cylinders 22, 24 extend around the first impression cylinder 16, is preferably less than 180°. In other words, the angle between the rotational axis of the first blanket cylinder 22*a* and the last blanket cylinder 22*d* with respect to the center of the first impression cylinder 16 is preferably smaller than 180°.

As described in regard to the first impression cylinder 16, a plurality of second blanket cylinders 28*a*, 28*b*, 28*c*, 28*d*, each associated with a respective second plate cylinder 30*a*, 30*b*, 30*c*, 30*d* and a second inking unit 32*a*, 32*b*, 32*c*, 32*d*, extend around a portion of the periphery of the second impression cylinder 18 for printing a second set of colors, e.g. cyan, magenta, yellow and black, to the second side 10*b* of the single web 10 in the perfecting mode or to the respective second side 8*b* of the second web 8 in the non-perfecting mode.

The plurality of second blanket cylinders 28*a*, 28*b*, 28*c*, 28*d* and corresponding second plate cylinders 30*a*, 30*b*, 30*c*, 30*d* and second inking units 32*a*, 32*b*, 32*c*, 32*d* may preferably be arranged symmetrically to the arrangement of the first blanket cylinders 22, plate cylinders 24 and inking units 26, with the plane of symmetry 34 extending through the center of the gap 20, formed between the first and the second impression cylinders 16, 18.

Although four blanket cylinders, plate cylinders and inking units are shown arranged around each of the first and second impression cylinders 16, 18, the basic principle of the invention is not limited to that number and those skilled in the art will understand that a smaller or larger number of blanket cylinders, plate cylinders and inking units may be associated with each impression cylinder without departing from the teachings of this invention. Furthermore, preferably all of the first and second blanket cylinders 22, 28, first and second plate cylinders 24, 30 and first and second inking units 26, 28 are preferably identical in design, but arranged differently with respect to the impression cylinders 16, 18 as shown in the drawings.

Furthermore, the inking units 26*a*, 26*b*, 26*c*, 26*d* associated with the first plate cylinders 24*a*, 24*b*, 24*c*, 24*d*, respectively, may preferably be known short inking units each of which applies a fluid ink of a single color to the corresponding first plate cylinder 24*a*, 24*b*, 24*c*, 24*d*.

In order to provide for a higher flexibility when consecutively running different print jobs, the first impression cylinder 16 and the second impression cylinder 18 may be driven independently by separate electric motors 52, with each of the respective blanket cylinders 22, 28, plate cylinders 24, 30 and inking units 26, 32 preferably being coupled to the corresponding one of the first arid second impression cylinders 16, 18 by respective gear trains (not shown). If desired, the blanket cylinders, plate cylinders and inking units may also be driven by separate electric motors 52.

In the preferred embodiment of the invention, a first infeed roller 36 may be located upstream of the first impression cylinder 16 (as viewed in the traveling direction of the first web 6 or the single web 10) for guiding the first web 6 or the single web 10 towards the periphery of the first impression cylinder 16. As seen in FIGS. 1 and 2, the first infeed roller 36 is preferably arranged such that the single web 10 or the first web 6 is passed towards the first impression cylinder 16 substantially tangentially to the first impression cylinder 16 and the first blanket cylinder 22*a*. Similarly, a second infeed roller 38 may be positioned upstream of the second impression cylinder 18, preferably adjacent to the first infeed roller 36. Similarly to the first infeed roller 36, the second infeed roller 38 is preferably arranged so that, in the non-perfecting mode, the second web 8 is fed to the second impression cylinder 18 substantially tangentially to the second impression cylinder 18 and the blanket cylinder 28*a*.

Moreover, first and second exit rollers 40, 42 associated with the first and second impression cylinders 16, 18, respectively, may be positioned so that, in the non-perfecting mode, the first web 6 is passed away from the first impression cylinder 16 substantially tangentially to the first impression cylinder 16 and the blanket cylinder 22*d*, as shown in FIG. 2. Similarly, the second exit roller 42 is preferably arranged so that the second web 8 or the single web 10 is passed away from the second impression cylinder 18 substantially tangentially with respect to the second impression cylinder 18 and the blanket cylinder 28*d* Instead of using known rollers for the entry and/or exit rollers 36, 38, 40 and 42, it is also possible to employ known air bars or other turning devices.

When printing in the perfecting mode, shown in FIGS. 1 and 4, the single web 10 is first passed over the first infeed roller 36 towards the first impression cylinder 16, passed around the first impression cylinder 16 where it is printed on its first side 10*a* by the first blanket cylinders 22 and is afterwards passed through the gap 20 towards the second impression cylinder 18, where it is printed on its second side 10*b* by the second blanket cylinders 28. Subsequently, the single web 10 is fed to a dryer or a further printing unit 12 or directly to a known folding apparatus 14 for further processing.

When printing in the non-perfecting mode, shown in FIG. 2, the first web 6 is passed via the first entry roller 36 to the first impression cylinder 16 to be printed only on its first side 6*a* by the first blanket cylinders 22 and associated plate cylinders 24. At the same time a second web 8 is passed over the second entry roller 38 towards the second impression cylinder 18, where it is printed on a second side 8*b* by the second blanket cylinders 28 and associated plate cylinders 30, before it is passed via the second exit roller 42 to a subsequent further printing unit or dryer or folding apparatus 14.

In the same way, it is also possible to print only one of the two webs 6, 8 in the non-perfecting mode, while the other web is stopped for a make-ready operation of the respective impression cylinder and/or plate and blanket cylinders. In other words in the non-perfecting mode, a make-ready operation of one web may be performed while the other web is printed, or two webs 6, 8 may be printed simultaneously.

As shown in FIG. 1 a known IR- or UV-dryer 44 may also be located adjacent to the surface of the first impression cylinder 16 for drying the first printed side 10*a* of the single web 10, before it is passed to the second impression cylinder 18 through the gap 20, in order to prevent smearing of the freshly printed image applied to the first side 10*a* of the single web 10 in the perfecting mode.

Accordingly, a further dryer 46 may optionally be provided between the blanket cylinder 22*d* and the first exit roller 40 for drying the first side 6*a* of the first web 6 in the non-perfecting mode.

In an even more preferred embodiment of the invention, an additional dryer 48 may be provided for drying, in the perfecting mode, the second side 10*b* of the single web 10 or for drying, in the non-perfecting mode, the second side 8*b* of the second web 8. The dryer 48 may preferably be located between the blanket cylinder 28*d* of the second variety of blanket cylinders 28 and the second exit roller 42. Although the single web 10 and/or the first and second webs 6, 8 are preferably dried by dryers 44, 46, 48 directly located within the printing unit 12 according to the present invention, it is also possible to alternatively or additionally use conventional dryers 50, which are indicated by dashed lines in FIGS. 3 and 4, in order to dry the running single web 10 and/or first and second webs 6, 8 before feeding them to a folding apparatus 14 for further processing.

Figure 5:
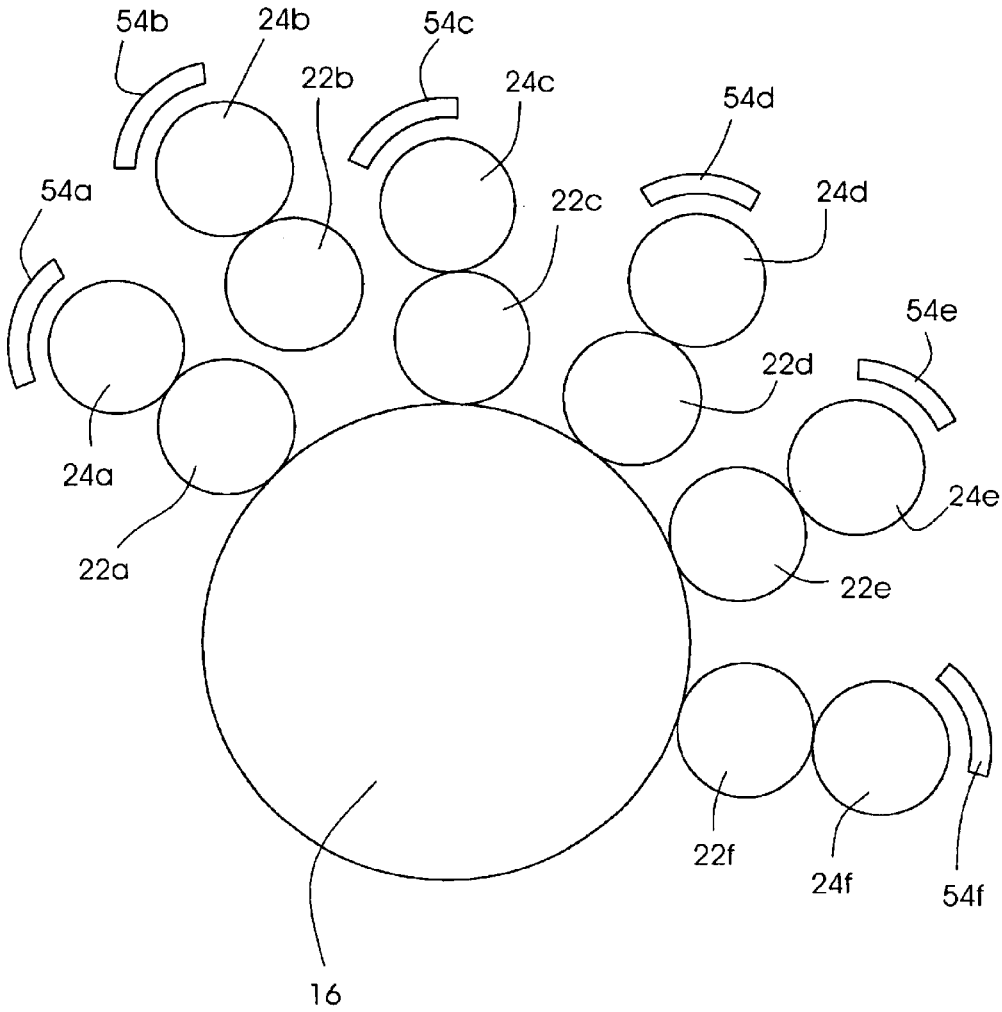
FIG. 5 shows a printing press according to a further embodiment of the invention wherein two of the plate cylinder/blanket cylinder units comprise direct imaging units.

As shown in FIG. 5, an alternate embodiment of the invention in which at least a portion of the printing units comprise direct imaging units. That is, each of the pairs of first blanket cylinders 22 and the corresponding first plate cylinders 24 comprise direct imaging printing units in which a direct imaging device 54 creates a magnetic field on the surface of one of the first plate cylinders 24 corresponding to an image portion to be printed by the respective printing unit. Thus, a toner or other imaging agent applied to the particular plate cylinder 24 adheres to the cylinder in a pattern corresponding to the magnetic field relating to the image portion and this image portion is then passed to the corresponding blanket cylinder 22 and, subsequently, to the web.

FIG. 5 shows a first impression cylinder 16, having a plurality of first blanket cylinders 22*a–f* and a corresponding plurality of first plate cylinders 24*a–f* arranged therearound. Each of the first plate cylinders 24*a–f* and the corresponding first blanket cylinders 22*a–f* are associated with a corresponding plurality of direct imaging devices 54*a–f*. Of course, those skilled in the art will understand that such a printing apparatus may contain any combination of direct imaging printing units and offset printing units.

In the embodiment of FIG. 5, the first blanket cylinders 22*a* and 22*b* with the is corresponding first plate cylinders 24*a* and 24*b* may, for example, print black text while the first blanket cylinders 22*c–f* and the corresponding first plate cylinders 24*c–f* each print images of a different color, e.g. cyan, magenta, yellow and black (e.g., for black picture portions), on a first side of either a first of two webs or one side of a single web 10. The arrangement of the first blanket cylinders 22*a–f* and the corresponding first plate cylinders 24*a–f* may be arranged around the impression cylinder 16 as shown in the previously described embodiments. Thus, an angle over which the first blanket and plate cylinders 22, 24 extend around the impression cylinder 16, is preferably less than 180°.

The embodiment of FIG. 5 allows an image currently being printed on the web to be changed to a new image without stopping the progress of the web To achieve this while the current image is being printed with, for example, each of first plate cylinders 24*a* and 24*c–f* and corresponding first blanket cylinders 22*a* and 22*c–f* in a printing position, first plate cylinder 24*b* and first blanket cylinder 22*b* are located in an off-impression position and the new image portion is imaged onto the first plate cylinder 24*b* by the direct imaging device 54*b*. As the web continues to run, the printing of an image including the new image portion applied by the direct imaging unit 54*b* may begin by moving first plate cylinder 24*a* and first blanket cylinder 24*b* out of the printing position and into the off-impression position while first plate cylinder 24*b* and first blanket cylinder 22*b* are moved from the off-impression position into the printing position. Then, a further image may be imaged onto the first plate cylinder 24*a* by the direct imaging device 54*a* and allowing the image printed on the web to be amended repeatedly with no interruption in the travel of the web.

Of course, those skilled in the art will understand that such a printing unit may be constructed with only 5 first blanket cylinders 22*a–e* and five plate cylinders 24*a–e* if one of the first blanket cylinders 22*a* and 22*b* is employed to print both the black text and black picture portions while the other of the first blanket cylinders 22*a* and 22*b* receives a new image portion from the corresponding direct imaging device 54. In addition, if eight first blanket cylinders and eight first plate cylinders are arranged around an impression cylinder, a first set of four first blanket cylinders and the corresponding four first plate cylinders may print a first four color image on the web while a second image is imaged onto the second set of four plate cylinders (currently in an off-impression position) by a corresponding plurality of direct imaging devices. Then, when it is desired to change the image, the first set of four plate cylinders and the corresponding blanket cylinders may be moved into the off-impression position while the second four plate cylinders and the corresponding blanket cylinders are moved into the printing position to apply the new image. At this point, a plurality of direct imaging devices corresponding to the first four plate cylinder/blanket cylinder units may apply an entirely new image to these cylinders and the image applied to the web may be completely changed repeatedly without interrupting the travel of the web.

As in the previous embodiments, a plurality of second blanket cylinders each associated with a respective second plate cylinder may be arranged as shown in the any of FIGS. 1–4 around a portion of the periphery of a second impression cylinder for printing a second set of colors, e.g. cyan, magenta, yellow and black, to the second side 10*b* of the single web 10 in the perfecting mode or to the respective second side 8*b* of the second web 8 in the non-perfecting mode with any or all of the printing units being direct imaging units.

It will be appreciated by those skilled in the art that the present invention can be embodied in other specific forms without departing from the spirit or essential characteristics thereof. The presently disclosed embodiments are therefore considered in all respects to be illustrative and restricted. The scope of the invention is indicated by the appended claims rather than the foregoing description and all changes that come within the meaning and the range and equivalence thereof are intended to be embraced therein.

What is claimed is:

1. A printing unit for a web-fed rotary printing press for alternatively printing only a first web in a perfecting mode and for printing the first web and a second web in a non-perfecting mode, wherein the first and second webs travel through the printing unit from an upstream end to a downstream end thereof, the printing unit comprising:

a first impression cylinder having at least a first and a second blanket cylinder arranged around at least a portion of a periphery of the first impression cylinder, at least a first and second plate cylinder, the first plate cylinder being associated with the first blanket cylinder, and the second plate cylinder being associated with the second blanket cylinder, a first direct imaging device for applying a first image to the first plate cylinder, a second direct imaging device for applying a second image to the second plate cylinder, means for cooperatively activating and deactivating the first and second plate cylinders and the first and second direct imaging devices, said means adapted to activate the first direct imaging device to apply the first image to the first plate cylinder while the second plate cylinder is in a printing position, and said means further adapted to activate the second direct imaging, device to apply the second image to the second plate cylinder while the first plate cylinder is in a printing position; and a second impression cylinder located adjacent to the first impression cylinder, the second impression cylinder having a plurality of third blanket cylinders and a corresponding plurality of third plate cylinders arranged around at least a portion of a periphery of the second impression cylinder, wherein, in the perfecting mode, the first web is passed over the first impression cylinder to be printed on a first side thereof and is then passed through a gap between the first and second impression cylinders to the second impression cylinder to be printed on a second side thereof, and wherein, in the non-perfecting mode, the first web is passed over the first impression cylinder and the second web is passed over the second impression cylinder, and wherein the first and second impression cylinders are driven by separate motors.

2. An apparatus according to claim 1, wherein a first infeed roller is arranged upstream of the first impression cylinder for guiding the first web toward the periphery of the first impression cylinder.

3. An apparatus according to claim 2, wherein the first infeed roller is arranged such that the first web is passed from the first infeed roller towards the first impression cylinder substantially tangentially to the first impression cylinder and an upstream-most one of the blanket cylinders associated with the first impression cylinder.

4. An apparatus according to claim 1, wherein a second infeed roller is arranged upstream of the second impression cylinder for guiding in the non-perfecting mode, the second web towards the periphery of the second impression cylinder.

5. An apparatus according to claim 4, wherein the second infeed roller is arranged such that the second web is passed towards the second impression cylinder substantially tangentially to the second impression cylinder and an upstream-most one of the third blanket cylinders.

6. An apparatus according to claim 1, wherein the first and second blanket cylinders and the corresponding first and second plate cylinders extend around the a periphery of the first impression cylinder by an angle of less than 180°.

7. An apparatus according to claim 1, wherein the third blanket cylinders and the corresponding third plate cylinders extend around the periphery of the first impression cylinder by an angle of less than 180°.

8. An apparatus according to claim 1, wherein a first exit roller is arranged downstream of the first impression cylinder for passing the first web away from the first impression cylinder.

9. An apparatus according to claim 8, wherein the first exit roller is arranged such that the first web is passed away from the first impression cylinder substantially tangentially to the first impression cylinder and a downstream-most one of the first and second blanket cylinders.

10. An apparatus according to claim 1, wherein a second exit roller is arranged downstream of the second impression cylinder for, in the perfecting mode, passing the first web away from the second impression cylinder and, in the non-perfecting mode, for passing the second web away from the second impression cylinder.

11. An apparatus according to claims 10, wherein the second exit roller is arranged such that, in the non-perfecting mode, the second web is passed away from the second impression cylinder substantially tangentially to the second impression cylinder and a downstream-most one of the third blanket cylinders.

12. An apparatus according to claim 1, wherein a first dryer is provided for drying, in the perfecting mode, a first side of the first web after it has been printed by one of the first and second blanket cylinders.

13. An apparatus according to claim 12, wherein a second dryer is provided for drying a second side of the web.

14. An apparatus according to claim 1, wherein a further dryer is provided for drying, in the non-perfecting mode, the first side of the first web after it has been printed by one of the first and second blanket cylinders.

* * * * *